US008198523B1

(12) United States Patent
Price

(10) Patent No.: US 8,198,523 B1
(45) Date of Patent: Jun. 12, 2012

(54) UNIVERSAL MUSIC STAND SLIP-COVER COMBINATION POCKET FOLDER

(76) Inventor: Suzanne Louise Price, Mont Vernon, NH (US)

( * ) Notice: Subject to any disclaimer, the term of this patent is extended or adjusted under 35 U.S.C. 154(b) by 134 days.

(21) Appl. No.: 12/788,265

(22) Filed: May 26, 2010

(51) Int. Cl.
*G10D 9/00* (2006.01)

(52) U.S. Cl. ..... 84/453

(58) Field of Classification Search ..... 84/453
See application file for complete search history.

(56) References Cited

U.S. PATENT DOCUMENTS

| | | | | | |
|---|---|---|---|---|---|
| 527,096 | A | | 10/1894 | Wunder | |
| 2,011,879 | A | | 8/1935 | Stein | |
| 2,016,176 | A | | 10/1935 | Rand | |
| 2,107,180 | A | | 2/1938 | Gihon | |
| 2,156,489 | A | * | 5/1939 | Bonetti | 248/461 |
| 2,160,205 | A | | 5/1939 | Grunier | |
| 2,272,551 | A | * | 2/1942 | Feldmann | 281/36 |
| 2,390,958 | A | * | 12/1945 | Perlin | 281/31 |
| 2,405,517 | A | * | 8/1946 | Plummer | 206/162 |
| 2,481,264 | A | * | 9/1949 | Tulowiecki | 248/461 |
| 2,502,275 | A | | 3/1950 | Perlin | |
| 2,581,763 | A | | 1/1952 | Hickler | |
| 2,717,671 | A | | 9/1955 | Arnold | |
| 3,023,794 | A | | 3/1962 | Lifton | |
| 3,489,194 | A | | 1/1970 | Hoover | |
| 3,809,352 | A | * | 5/1974 | Mathias | 248/444.1 |
| D241,393 | S | * | 9/1976 | St. Regis | D6/300 |
| 4,128,176 | A | * | 12/1978 | Green | 211/45 |
| 4,213,520 | A | * | 7/1980 | Sarna et al. | 248/444.1 |
| 4,360,183 | A | * | 11/1982 | Biasini | 248/451 |
| 4,632,241 | A | * | 12/1986 | Brough et al. | 206/764 |
| 4,703,952 | A | | 11/1987 | Biasini | |
| 4,773,535 | A | * | 9/1988 | Cook | 206/373 |
| 4,872,538 | A | | 10/1989 | Fournier | |
| 4,901,899 | A | * | 2/1990 | Barrett | 224/223 |
| 5,180,191 | A | | 1/1993 | Biba | |
| 5,356,109 | A | * | 10/1994 | Biasini | 248/448 |

(Continued)

FOREIGN PATENT DOCUMENTS

DE 3928727 A1 * 3/1991

(Continued)

*Primary Examiner* — David S. Warren
*Assistant Examiner* — Robert W Horn
(74) *Attorney, Agent, or Firm* — Devine, Millimet & Branch Professional Association; Kimberly A. W. Peaslee

(57) ABSTRACT

A universal music stand slip-cover combination pocket folder keeps music, papers, books and accessories securely on a music stand. One embodiment has a durable, sturdy yet pliant slip-cover (20) with an attached pocket folder (22) that fits onto a standard flat desk music stand. The slip-cover combination pocket folder has a stabilizer (16) sandwiched within the embodiment to help it maintain its shape. The front pocket folder (22) of the universal music stand slip-cover makes the placement of music, papers, books, and accessories on a music stand very convenient, so a transfer of loose music from book bag to music stand and back is unnecessary. The retaining straps (26*a*, 26*b*) attached to the pocket folder (22) keep viewable music on the stand. The slip-cover (20) has a tab flap (34) on the back panel (14) that allows it to adapt to any folding music stand design thus making it universal. The Universal Music Stand Slip-Cover Combination Pocket Folder fits easily into a backpack or can be carried with a carrying strap. The slip-cover gives a more formal appearance on the concert stage, extends the life of a music stand and covers up music stand imperfections. Other embodiments are described and shown.

14 Claims, 6 Drawing Sheets

U.S. PATENT DOCUMENTS

| | | | | |
|---|---|---|---|---|
| 5,413,305 | A * | 5/1995 | Leeb | 248/460 |
| 5,653,333 | A | 8/1997 | Webster | |
| 5,941,496 | A | 8/1999 | Banner | |
| D416,679 | S | 11/1999 | Livingston | |
| D434,901 | S | 12/2000 | Eskandry | |
| 6,305,498 | B1 * | 10/2001 | Itzkovitch | 182/129 |
| D461,977 | S * | 8/2002 | Mitchell | D6/509 |
| 6,441,288 | B1 * | 8/2002 | Lin | 84/453 |
| 6,563,036 | B1 * | 5/2003 | Biasini | 84/453 |
| 6,889,950 | B2 * | 5/2005 | Evanoff | 248/441.1 |
| 7,055,652 | B1 * | 6/2006 | Williams | 182/129 |
| 7,578,487 | B2 | 8/2009 | Kaneda | |
| 2002/0092407 | A1 * | 7/2002 | Lin | 84/453 |
| 2005/0012014 | A1 * | 1/2005 | Willner et al. | 248/441.1 |
| 2007/0049477 | A1 * | 3/2007 | Hester et al. | 493/374 |
| 2008/0190721 | A1 | 8/2008 | Burton | |
| 2011/0203953 | A1 * | 8/2011 | Fowler, II | 206/314 |

FOREIGN PATENT DOCUMENTS

| | | |
|---|---|---|
| GB | 2370981 | 7/2002 |
| GB | 2426924 | 2/2006 |
| JP | 3153043 U * | 8/2009 |

* cited by examiner

UNIVERSAL MUSIC STAND SLIP-COVER COMBINATION POCKET FOLDER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of the Disclosure

This application relates to a music stand slip cover and sheet music retaining and storing apparatus.

2. Prior Art

Musicians use music stands to display sometimes two or three sheets of music at one time while they play various instruments. Music stands allow for the music sheets to rest on a shelf or lip, secured by gravity, holding the sheets against the lip and back of the stand. When bumped, music stands tend to sway, knocking music to the floor. In the event that a flat desk music stand falls down, it gets scratched, nicked, and bent especially after many years of use. Musicians have to paint their existing stands or buy new ones in order for them to look like new on stage. This can become costly for school districts already faced with budget cuts.

The inventor's string teacher had music stands that had been autographed by former students and wondered how she could use them at her church without the distraction of all her former students' signatures. The inventor came up with the idea for a cover for the stand. Furthermore, it would be advantageous if a portable slip-cover could be slipped onto the stand to secure the music to the stand. In addition, it would be convenient if a pocket or folder attached to the slip-cover was available to hold and store music, books or accessories.

When carrying music, books, or accessories from one place to another, these items need to be removed from one storage bag to be placed on the music stand and then replaced to the storage bag when not in use. Sometimes in the transfer, music pages end up in the wrong order or get lost or misplaced. These items would need to be searched for which takes time. Music, books, or accessories which might be stored in a separate bag or carrying case may not be readily available. Students frequently leave their belongings elsewhere when it comes time to perform and then have to retrieve them. It would be handy and a time saver if the music, books, or accessories could be secured and transported within the same structure. The Universal Music Slip-Cover Combination Pocket Folder, when removed from the music stand, could be folded in half, securing the music, books and accessories within, and transported with the user from one place to another.

When carrying music from one place to another, different styles of music stands, such as a flat desk music stand or a folding stand might be available. Musicians and others wishing to use music stands to hold various papers and accessories in a secure and orderly manner would appreciate the availability of a slip cover that would adapt to different styles of music stands so sheet music or papers could be easily transferred for use at any location. A universal structure which secures music to music stands of differing styles would be helpful so the music stand itself does not have to be transported with the user.

Several types of music carrying cases have been proposed—for example, U.S. Pat. No. 527,096 (1894) to Wunder, U.S. Pat. No. 2,016,176 (1935) to Rand, U.S. Pat. No. 2,481,264 (1949) to Tulowiecki, U.S. Pat. No. 5,653,333 (1997) to Webster, U.S. Pat. Nos. 4,703,952 (1987) and 6,563,036 (2003) to Biasini, U.S. Pat. No. 6,889,950 (2005) to Evanoff. These inventions do not universally adapt to other music stands. Some applications require the user to transport the entire apparatus and assemble it on site.

U.S. Pat. No. 2,016,176 issued to Rand for a Music Container is not adaptable to other music stands.

U.S. Pat. No. 5,653,333 to Webster for the Combined Portable Container and Display Stand does not adapt to other music stands. It does not slip over a music stand and hide any imperfections.

U.S. Pat. No. 6,563,036 issued to Biasini for the Edge Mounted Trap Bag. The bag would interfere with anyone in a seated position and is designed for storing percussion mallets rather than sheet music.

U.S. Pat. No. 6,889,950 issued to Evanoff for the Portable Music Stand Top & Case is not adaptable to other music stands. The entire music stand and materials contained therein must be transported with the user. The stand must also be assembled and disassembled at each location of use. This would be cumbersome for young music students to carry as they already carry their school bag and instrument when going to and from school.

U.S. Pat. No. 7,578,487 issued to Kaneda and Kishi discloses a sheet music receiving frame for receiving music paper. However, this invention does not cover imperfections in an existing music stand and its rigid structure does not allow flexibility in transport.

Patent Application Number US200510012014 issued to Willner for the Sheet Music Stand Helper does not adapt to different styles of music stands. It uses only one layer of fabric and so would be rather flimsy. I have also found that music enclosed in a plastic sleeve is difficult to read due to the glare of stage lighting. Furthermore, it would not have a professional look on a stage with music or accessories being stored in the pocket on the back panel nor would the music be secured within the structure while being transported.

ADVANTAGES

From the descriptions above, a number of advantages of my invention become evident.

The Universal Music Stand Slip-Cover Combination Pocket Folder would secure music, papers or accessories to a music stand. If the music stand was bumped, music in the pocket folder would be held securely and would remain on the stand rather than fall on the floor.

The pocket folder portion of the music stand slip-cover would store music or papers and keep them organized and together in one place. Music books often fall apart after much use and sheet music can get lost or out of order when being transferred from a separate folder to a music stand. Sheet music, books or accessories would be less likely to be lost or misplaced because they would be retained securely in the pocket folder portion of the slip-cover.

Sheet music or papers being viewed would be secured to the front of the folder by securing devices such as elastic, plastic, fabric or metal straps. Music would be held securely on the music stand even outside in windy weather.

The Universal Music Stand Slip-Cover Combination Pocket Folder is universal for use with any standard size music stand. With its design, the slip-cover's use can be transferred from a metal folding stand to a flat desk stand or vice versa. For example, it can be used on a folding style music stand at home and transferred to a flat desk style of music stand for use on a stage or at school. Furthermore, this eliminates the need to carry a music stand from one place to another.

The Universal Music Stand Slip-Cover Combination Pocket Folder would cover imperfections in any music stand and would look dressy from the audience's perspective. It would give the music stand a more formal and uniform appearance on the concert stage. Professional bands or orchestras, colleges, universities, and school or group logos could be imprinted on the cover thus using it for identification or advertising purposes.

The Universal Music Stand Slip-Cover Combination Pocket Folder would be washable and durable due to its construction. This will help the slip-cover maintain its appearance and extend the life-span of a music stand as it will protect the stand from dings and scratches.

When folded, the Universal Music Stand Slip-Cover Combination Pocket Folder will fit in a backpack or it can be carried with a removable strap or handles.

Thus several advantages of one or more aspects are to provide an easier way to store and transport music, books or accessories. Other advantages of one or more aspects are to provide a music stand slip-cover that can be used universally on different styles of music stands and that covers up imperfections on existing flat desk stands. It would solve an unsolved need. These and other advantages of one or more aspects will become apparent from a consideration of the ensuing description and accompanying drawings.

SUMMARY

In accordance with one embodiment, a Universal Music Stand Slip-Cover Combination Pocket Folder comprises a slip-cover that fits over a flat desk music stand, a pocket folder attached to the slip-cover, retaining devices, a tab flap that allows the slip-cover to adhere to a folding metal music stand, a pocket for writing implements, and loops so that it may be transported by a carrying strap. It can be used universally with metal music folding stands and flat desk music stands and folds easily, securing music, books or accessories within for transport from one location to another. It hides music stand imperfections, protects them from dings and scratches and provides a way for groups to advertise or be identified by having their logo imprinted on the slip-cover.

DRAWINGS

Figures

FIG. 1 shows a Universal Music Stand Slip-Cover Combination Pocket Folder in its initial stage and divided into three panels with a stabilizer insert in accordance with one embodiment.

FIG. 2*a* shows an isometric view of a Universal Music Stand Slip-Cover Combination Pocket Folder when folded on the fold lines before assembly in accordance with one embodiment.

FIG. 2*b* shows an isometric view of a Universal Music Stand Slip-Cover Combination Pocket Folder when folded on the fold lines and stitched on the edges in accordance with one embodiment.

FIG. 2*c* shows a front view of a Universal Music Stand Slip-Cover Combination Pocket Folder with placement of zipper, retaining straps, shoulder strap loops, and writing implement pocket in accordance with one embodiment.

FIG. 2*d* shows a view of the front of the Universal Music Stand Slip-Cover Combination Pocket Folder being slipped onto a music stand.

FIG. 2*e* shows a view of the Universal Music Stand Slip-Cover opening that slides over a flat desk music stand in accordance with one embodiment.

FIG. 3*a* shows a back view of the Universal Music Stand Slip-Cover Combination Pocket Folder on a flat desk music stand in accordance with one embodiment.

FIG. 3*b* shows a back view of the Universal Music Stand Slip-Cover Combination Pocket Folder on a metal folding music stand with a tab flap securing the slip-cover to the stand in accordance with one embodiment.

FIG. 3*c* shows a side view of the Universal Music Stand Slip-Cover Combination Pocket Folder on a flat desk music stand in accordance with one embodiment.

FIG. 4*a* show a front view of the Universal Music Stand Slip-Cover Combination Pocket Folder when it is folded in half in accordance with one embodiment.

FIG. 4*b* shows an isometric view of the Universal Music Stand Slip-Cover Combination Pocket Folder when it is folded and zipped closed in accordance with one embodiment.

REFERENCE NUMERALS

| Number | Part Name |
|---|---|
| 10 | front notched panel |
| 11 | fold line |
| 12 | middle panel |
| 13 | fold line |
| 14 | back panel |
| 16 | stabilizer insert |
| 20 | slip cover |
| 21 | slip cover opening |
| 22 | pocket folder |
| 23 | pocket folder opening |
| 26a | sheet music retaining strap |
| 26b | sheet music retaining strap |
| 28 | writing implement pocket |
| 29 | zipper |
| 32 | apron |
| 34 | tab flap |
| 44a | carrying strap loop |
| 44b | carrying strap loop |
| 46 | fabric edge binding |
| 62L | plastic quarter circle |
| 62R | plastic quarter circle |
| 72L | snap |
| 72R | snap |
| 74L | sheet music retaining strap |
| 74R | sheet music retaining strap |

DETAILED DESCRIPTION

First Embodiment

This embodiment relates to a Universal Music Stand Slip Cover Combination Pocket Folder that fits over a music stand, of the type used to display sheet music for a musician, which performs the purpose of holding music, papers, books, writing implements and accessories via securing devices and pockets. More specifically, the Universal Music Stand Slip-Cover Combination Pocket Folder is a removable slip-cover that slides onto a flat desk music stand or a metal folding music stand with a folder attached to the slip-cover for storing and securely holding music, books, and accessories, and one or more pockets attached to the folder for storing writing implements or accessories. Retaining straps hold viewable sheet music to the pocket folder when on a stand. When not on a music stand, the Universal Music Stand Slip-Cover Combination Pocket Folder can be folded in half. With its edges fastened together, the music, books and accessories that are being stored within, can be transported.

Figure 1:
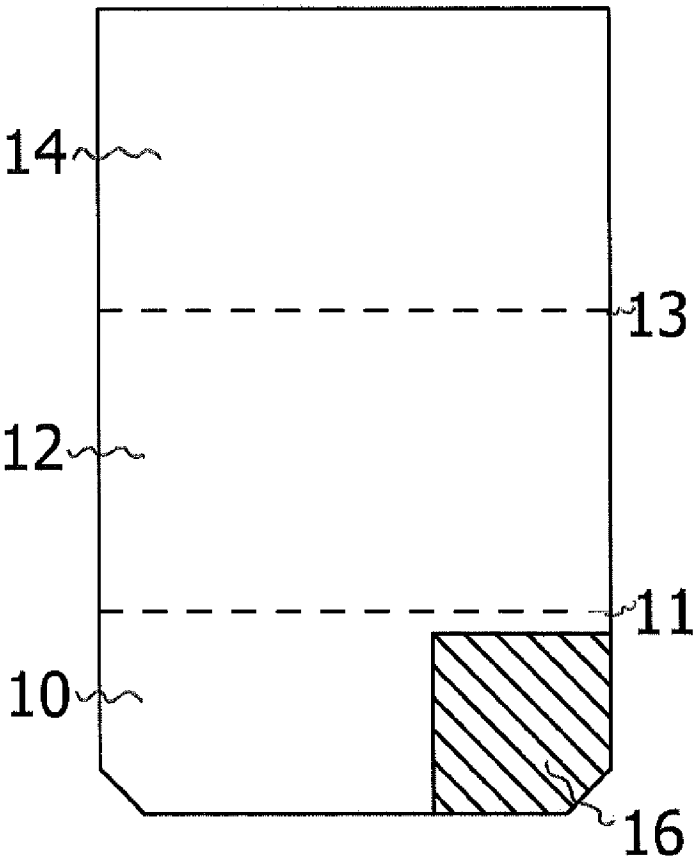

FIG. 1 shows one embodiment of the universal music stand slip cover in its initial stage. The edges of two rectangular pieces of fabric of predetermined size are joined together creating a front side and a back side with two of the corners being notched. I contemplate that the edges be secured together by sewing but other ways may be suitable. Two fold lines 11, 13 divide the fabric into 3 panels 10, 12, 14 with panel 10 being the notched panel. I contemplate that the fabric of this embodiment be of durable nylon, canvas, knit, duck cloth or cotton, but other materials are also suitable. I also contemplate that the exterior fabric be black to match the music stand support post. For this embodiment to maintain its shape, a stabilizer insert 16 is sandwiched between the two fabrics. I contemplate that this stabilizer be an iron-on fabric, nylon mesh, or a thin plastic insert which would allow the embodiment to be washable, however, a cardboard insert or other suitable material could also be used.

Figure 2A:
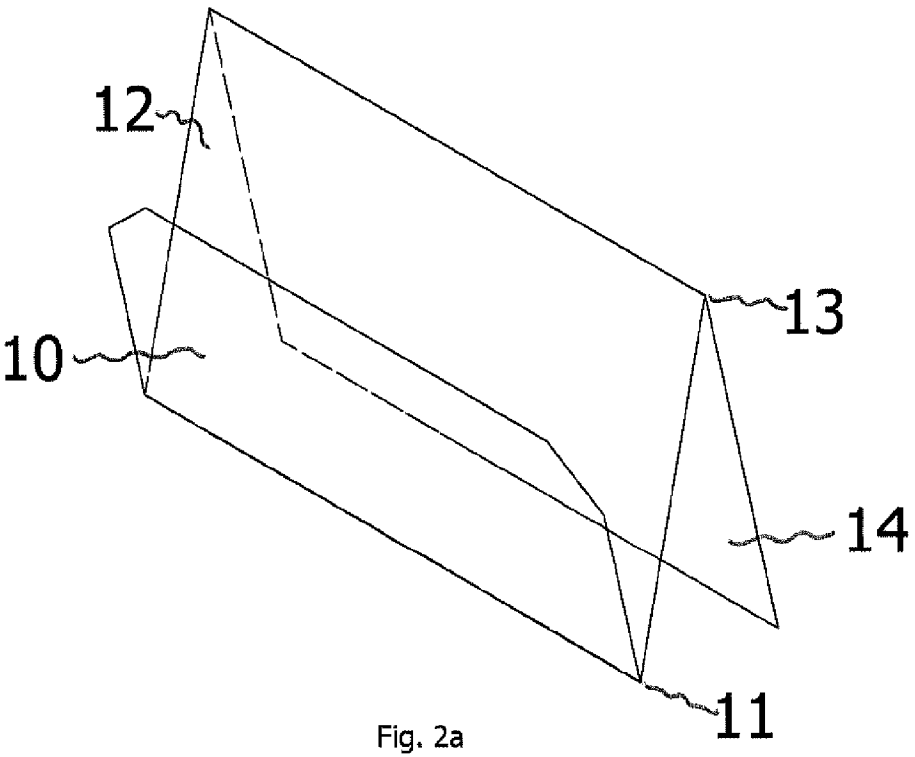

FIG. 2*a* shows the embodiment when folded on fold lines 11, 13. When the material of the Universal Music Stand Slip-Cover Combination Pocket Folder is folded on fold lines 11 and 13, front panel 10, middle panel 12, and back panel 14 are formed. When back panel 14 is folded down on fold line 13 against the back side of middle panel 12 and secured on the edges by sewing or other means, slip cover 20 is formed, allowing slip cover 20 to slide over a standard flat desk music stand. When notched panel 10 is folded up on fold line 11 against front side of middle panel 12 and secured on the edges by sewing or other means, pocket folder 22 is formed.

Figure 2C:
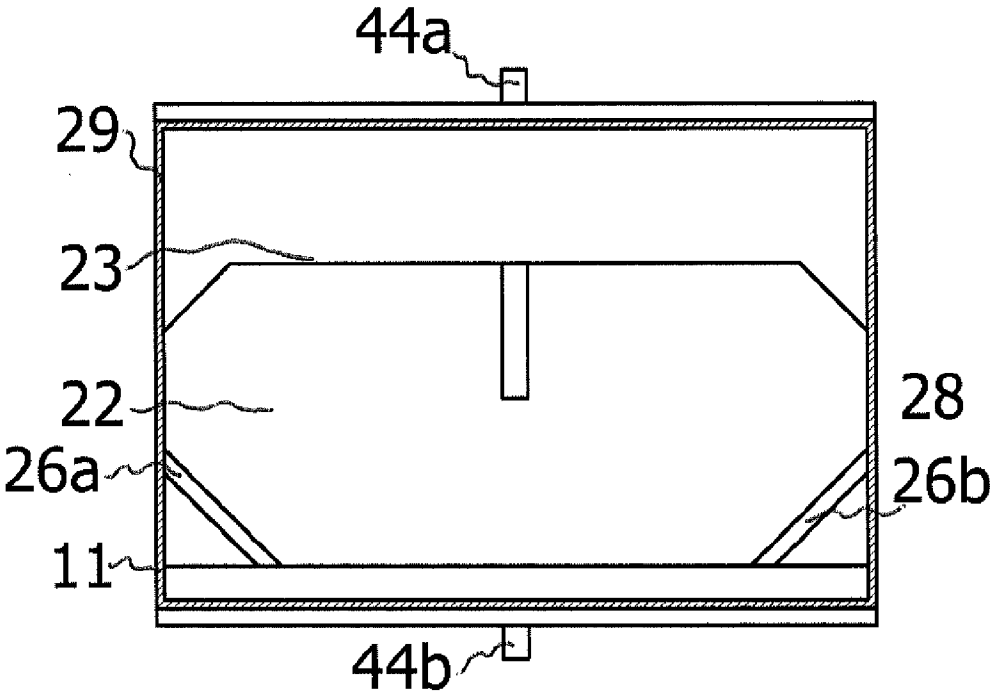
Figure 2B:
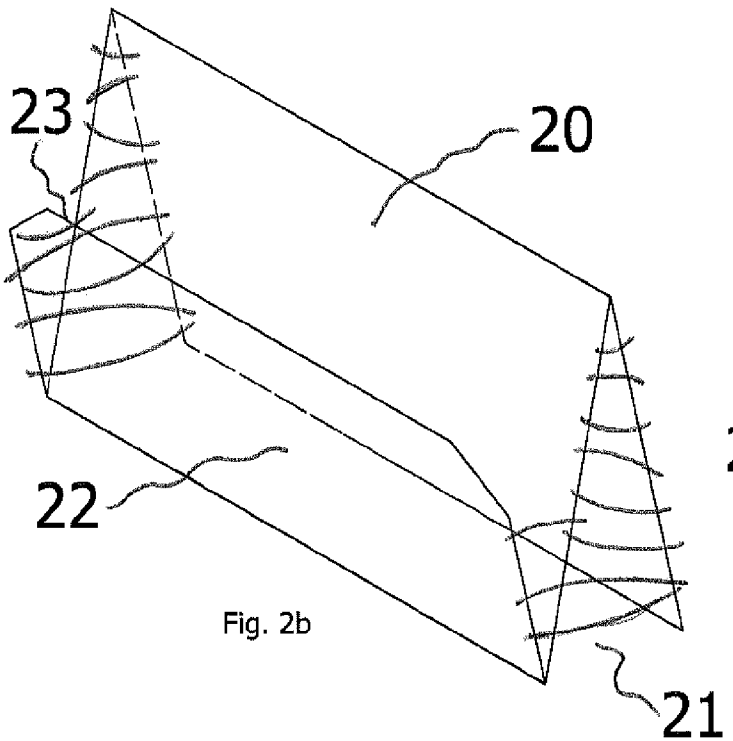

FIG. 2*b* shows the embodiment with its folded panels 10, 12, 14 and connected together at the sides via stitching with thread. When the sides of 12 and 14 are joined together, they form slip cover 20 with two joined sides, a fold at the top and an opening at the bottom 21 allowing the Universal Music Stand Slip-Cover to slip over a flat desk music stand as in FIG. 2*d*. When the sides of 10 and 12 are joined together, they form a pocket folder 22 with two joined sides, a fold at the bottom and a pocket folder opening 23 on the notched edge of the panel 10. Front panel 10 is recessed from the top to allow the viewing of papers within pocket folder 22. Pocket folder 22 is notched on each side so music, paper, books, and accessories can be inserted easily.

FIG. 2*c* shows a frontal view of one embodiment. Diagonally attached from the left side of pocket folder 22 to bottom left fold line 11 and the right side of pocket folder 22 to bottom right fold line 11 are retaining straps 26*a*, 26*b* made of elastic, cloth, plastic or metal that hold music or accessories to pocket folder 22. Dividing pocket folder 22 at the center, are two vertical lines of stitching starting at pocket folder opening 23. These vertical lines of stitching are approximately 10 cm long and parallel to each other. This stitching joins panel 10 to panel 12 to create an accessory pocket 28 for writing implements or accessories. I contemplate that the parallel stitched lines are approximately 19 mm apart but other widths are acceptable. A horizontal line of stitching connects the ends of the two parallel lines of stitching in the middle of pocket folder 22. This stitching adds stability to pocket folder 22 and creates two separate storage pockets for sheet music, papers or books as well as accessory pocket 28.

Figure 4B:
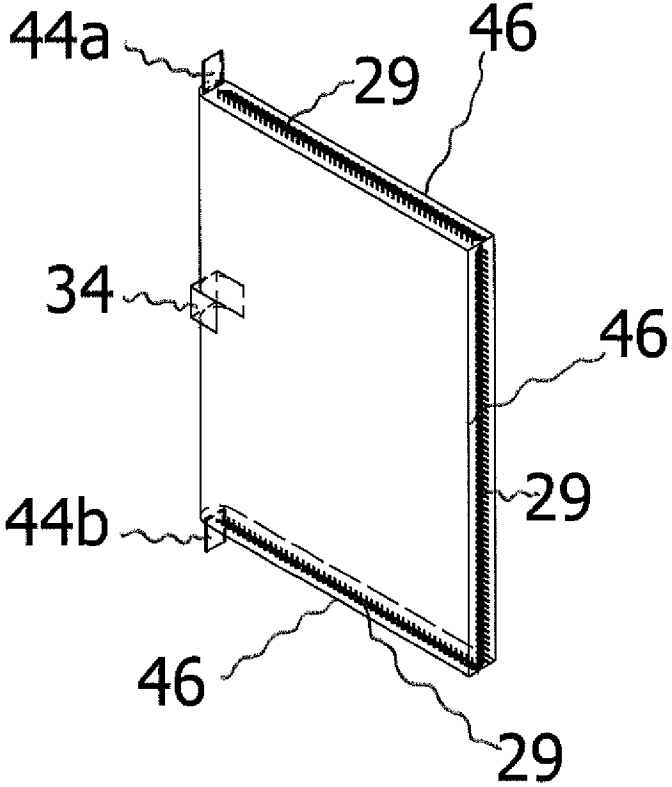

I contemplate that sheet music, books, papers, and accessories be secured in this embodiment with a zipper 29 around the bottom, sides and top edges as in FIG. 4*b*.

Figure 2E:
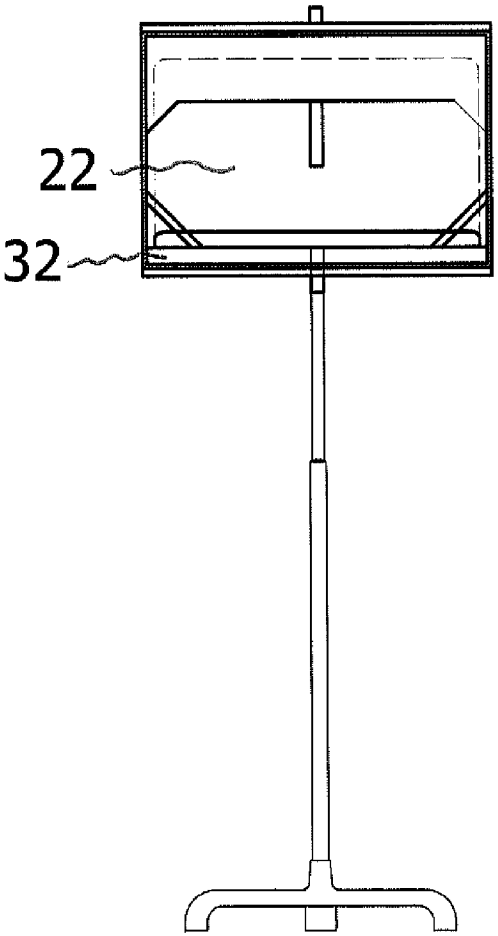
Figure 2D:
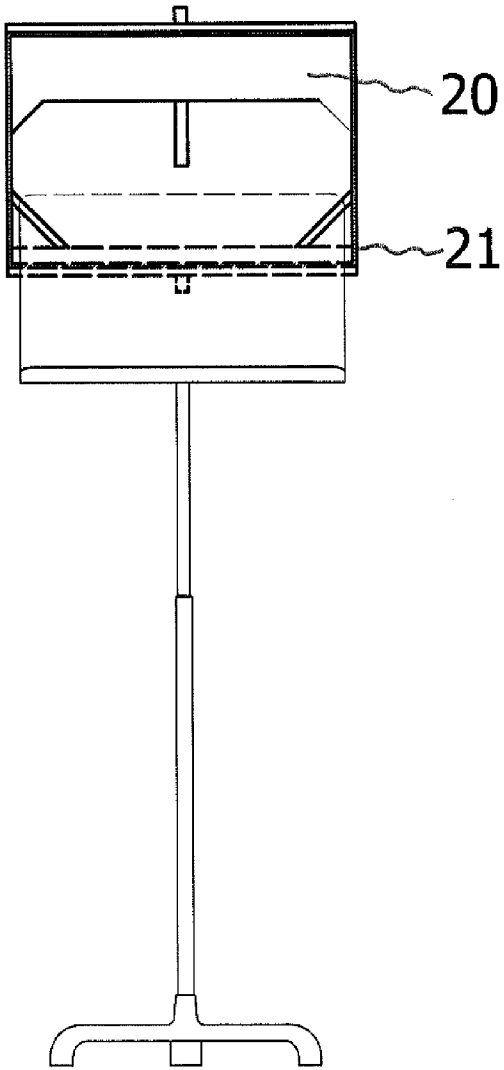

FIG. 2*d* shows slip-cover opening 21 of slip-cover 20 of the Universal Music Stand Slip-Cover being slipped onto a flat desk music stand. When the music stand is completely covered by the Universal Music Stand Slip-Cover, pocket folder 22 sits on the lip of the music stand as in FIG. 2*e* and FIG. 3*c*.

Figure 3C:
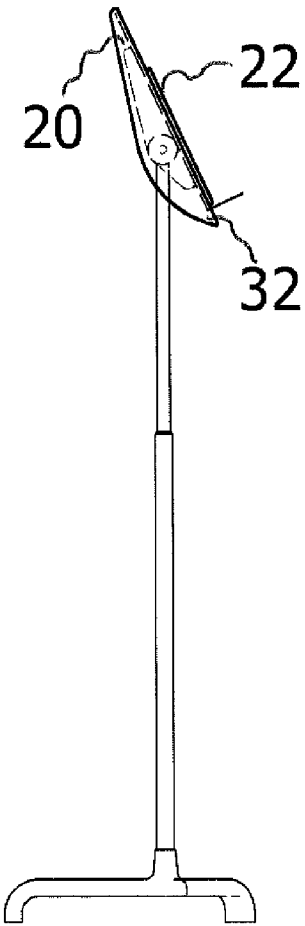
Figure 3B:
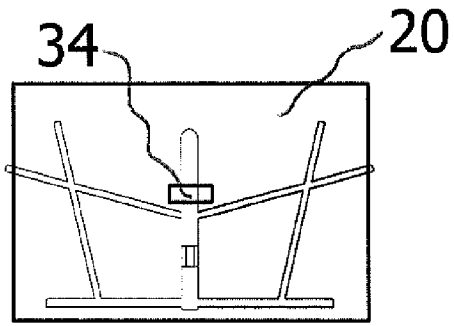
Figure 3A:
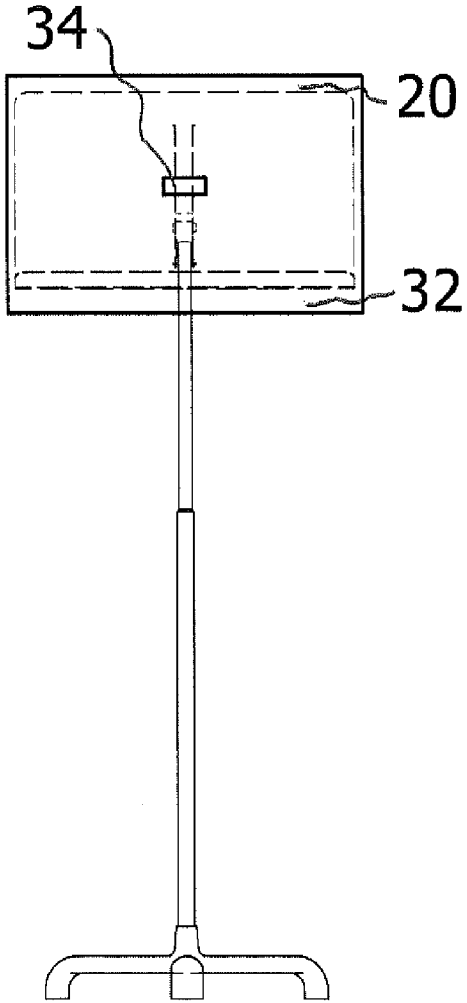

FIG. 3*a* shows the back view of the Universal Music Stand Slip-Cover while on a flat desk music stand. The hinge of the music stand is hidden behind the material used in the embodiment. Slip-Cover 20 extends below the lip of the flat desk music stand to form a narrow apron 32. I contemplate that this apron extends approximately 25 mm below the lip of the music stand to accommodate the attachment of zipper 29 on the interior of back panel 14.

FIG. 3*b* shows the back view of the Universal Music Stand Slip-Cover while on a metal folding music stand. In the center of back panel 14 is a horizontal tab flap 34. Tab flap 34 is a rectangular strip of wide elastic of the same or similar fabric as the embodiment. I contemplate that one narrow edge of tab flap 34 is affixed by sewing to the exterior of back panel 14 of the Universal Music Stand Slip-Cover while the other side be affixed by Velcro for ease of placement by the user. Tab flap 34 is of sufficient length to allow slip cover 20 to be secured to the center support post of a metal folding music stand by wrapping tab flap 34 around the support post. This allows slip-cover 20 to be used with different styles of music stands, thus making it universal.

Figure 4A:
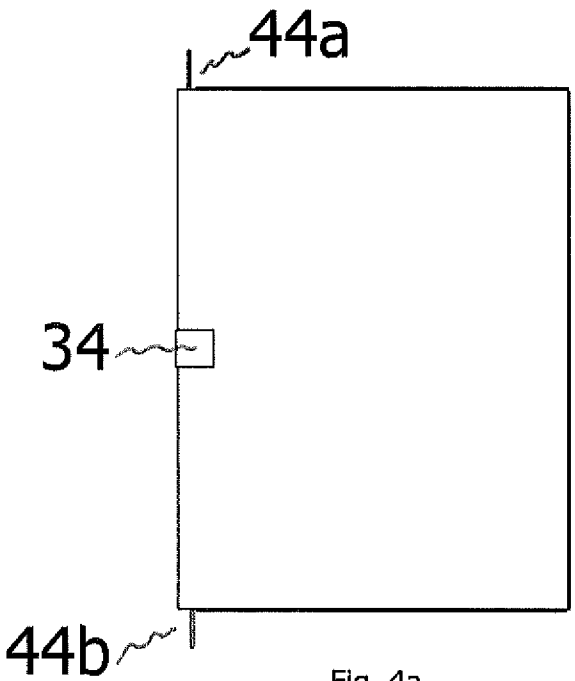

FIG. 4*a* shows one version of said embodiment when the Universal Music Stand Slip-Cover Combination Pocket Folder is removed from the music stand and folded in half. When it is folded, zipper 29 can be zipped, securing music, papers, books, and accessories inside the embodiment as shown in FIG. 4*b*. The zipper will close the top, bottom and side edges of the embodiment. One version of carrying the embodiment is with a removable conventional shoulder strap (not shown). Two loops 44*a*, 44*b* made of the same or similar fabric are attached on the edges of the center fold by sewing or other means where zipper 29 begins and ends. Conventional clips (not shown) attached at the two ends of the shoulder strap fasten to each loop 44*a*, 44*b* on the embodiment when in use. Fabric edge binding 46 positioned around the edges of the embodiment are attached on both sides of the fabric edges to reinforce and cover them for an all around finished look.

Operation

First Embodiment

To use the Universal Music Stand Slip-Cover Combination Pocket Folder, separate back panel 14 from middle panel 12 forming slip-cover 20 and slide slip-cover opening 21 over the desk of a flat desk music stand (FIG. 2*d*) until pocket folder 22 sits on the lip of the stand (FIG. 2*e* and FIG. 3*c*). To use with a metal folding music stand, place the Universal Music Stand Slip-Cover on the lip of the music stand. Wrap tab flap 34 over the center post of the stand and adhere to the opposite side of the post to back panel 14 (FIG. 3*b*). Place music, papers or accessories in pocket folder 22. To view music or papers, place the corner edge of the article to be viewed behind the retaining strap to hold it in place. Place writing implement in writing implement pocket 28. To transport music, papers, or accessories, remove the Universal Music Stand Slip-Cover Combination Pocket Folder from the music stand and fold it in half on the center fold, securing the edges with zipper 29 (FIG. 4*b*). Attach the shoulder strap to carrying strap loops 44*a* and 44*b*.

Description

Additional Embodiment

Figure 5:
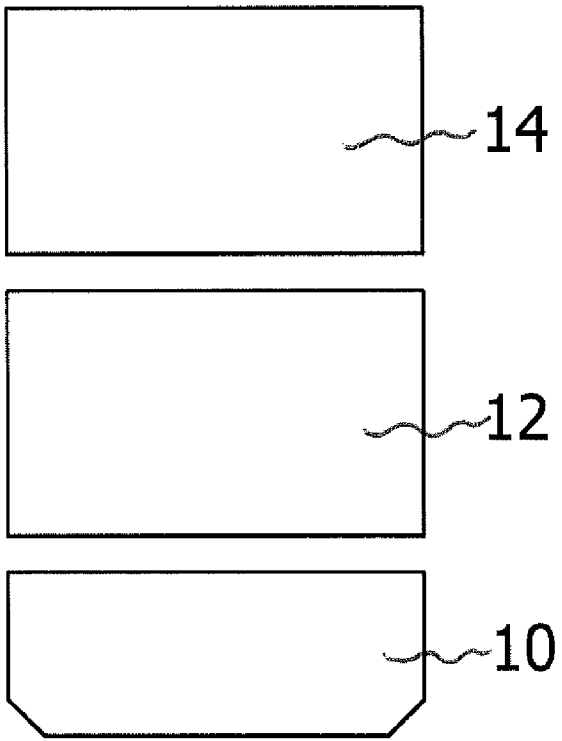
FIG. 5 shows a Universal Music Stand Slip-Cover Combination Pocket Folder divided into three detached panels in its initial stage in accordance with another embodiment.

In another embodiment of the Universal Music Stand Slip-Cover Combination Pocket Folder shown in FIG. 5, the fabric for panels 10, 12, and 14 are cut separately from each other and then assembled by stitching or other means. This would allow one panel to be assembled with one type of stabilizer and another panel assembled with a different stabilizer before the panels were all assembled together. A preferred embodiment is with a rigid stabilizer in middle panel 12 to help the slip-cover retain its shape. Furthermore, stabilizer 16 in front panel 10 should be sturdy in order to keep retaining straps taut against front pocket 22. Stabilizer 16 in back panel 14 should be flexible so that when back panel 14 slides over a flat desk music stand it slides easily and conforms to the positioning hinge on the back of the music stand. Stabilizers could be used throughout the entire embodiment, just partially or none at all.

Alternative Embodiments

Figure 6:
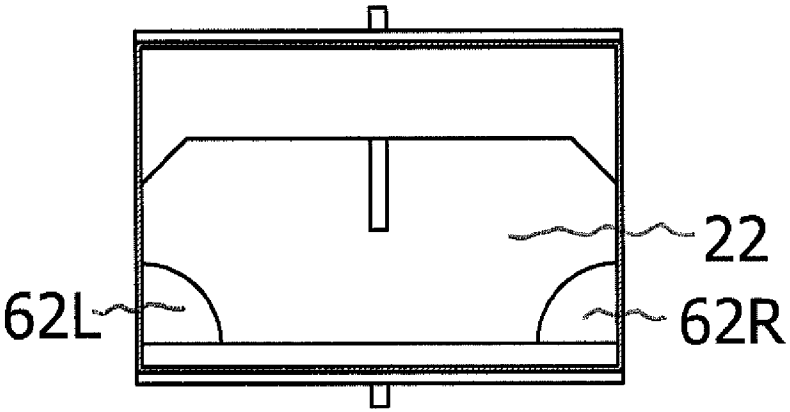
FIG. 6 shows a front view of a Universal Music Stand Slip-Cover Combination Pocket Folder with transparent plastic retaining quarter circles in accordance with another embodiment.

Another embodiment as seen in FIG. 6 includes a transparent plastic quarter circle 62 attached to both corners of the bottom of pocket folder 22. This would allow an unhampered view of the corner of the sheet music while securing it to pocket folder 22.

Figure 7:
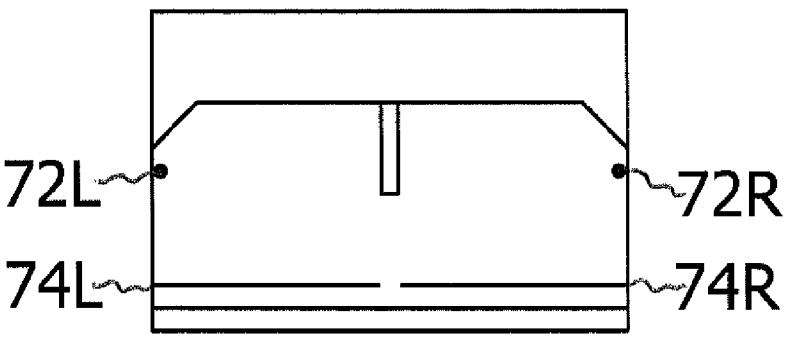
FIG. 7 shows a front view of a Universal Music Stand Slip-Cover Combination Pocket Folder with retaining straps and snap closures in accordance with another embodiment.

Alternatively as shown in FIG. 7, individual retaining straps 74L, 74R are attached from the bottom left and bottom right side of the pocket folder to the bottom center fold so music can be secured to the pocket folder while resting on the lip of the music stand. Heavy duty snaps 72L, 72R centered on both the left and right side edges are used to secure the sides together rather than a zipper when the Universal Music Stand Slip-Cover Combination Pocket Folder is folded in half. Other means such as Velcro, buttons, ribbons, magnets or any way that someone skilled in the art would readily conceive of alterations to, variations of and equivalents to these aspects could be used.

A magnetic strip, adhering to the fabric of the embodiment and placed vertically along the exterior center fold will allow the Universal Music Stand Slip-Cover to stick to the center post of a metal folding stand.

Conclusion, Ramifications, AND Scope

Thus the reader will see that at least one embodiment of the Universal Music Stand Slip-Cover Combination Pocket Folder provides a convenient, organized, lightweight device that can be used by persons of almost any age. It can be used universally with different style music stands providing an ease of transfer from one music stand to another. It folds easily, securing music, books, and accessories within for transport from one location to another and secures music to the stand while being viewed even in windy weather. With the use of durable fabrics in its manufacture, the Universal Music Stand Slip-Cover Combination Pocket Folder can be washed to maintain its appearance. It will extend the life-span of an existing music stand and protect it from dings and scratches should it happen to get knocked to the floor. It hides existing imperfections giving the music stand a professional, formal, and unified look when on stage. Professional groups could have their logos imprinted on the slip-cover thus using it for identification or advertisement purposes. It can fit in a backpack or it can be carried with a removable strap.

Although the description above contains much specificity, these should not be construed as limiting the scope of the embodiments but as merely providing illustrations of some of several embodiments. For example, a line of stitching on fold line 11 and 13 could hold separate stabilizers 16 in place within each panel. Additional securing devices may be added to the exterior of panel 14 to secure it to a metal folding stand. Additional accessory pockets could be attached inside or outside of pocket folder 22. Handles could be secured to the structure as an alternative to the carrying strap.

Thus the scope of the embodiments should be determined by the appended claims and their legal equivalents, rather than by the examples given.

I claim:

1. A universal music stand slip cover combination pocket folder comprising a main compartment dimensioned to fit over at least all or a portion of the sheetbearing part of a music stand, with an aperture on at least one side to permit addition to or removal from a music stand, wherein the improvement comprises:

a. a main structure having a rectangular shape with a front, a middle, and an elongated back panel, each connected at the sides to the other panels wherein each panel has two layers of material, and b. a stabilizer sandwiched between the two layers of material that rigidly reinforces the joined panels from bending or collapsing, except providing for a bend along the center of the width direction where the combination can fold in half for converting the slipcover into a pocket folder, whereby music, papers, books or accessories are securable on the slip cover to be viewed or stored when the main structure is placed over the music stand, and whereby the music, papers, books or accessories can be stored or transported easily by a human by removing the main structure from the music stand, folding it and forming a pocket folder of the folded portions and placing the items in the pocket folder.

2. The universal music stand slip cover combination pocket folder of claim 1, wherein the middle panel and the elongated back panel are connected at the sides and at the top, thereby forming an opening at the bottom dimensioned to slip over a flat desk music stand.

3. The universal music stand slip cover combination pocket folder of claim 2 further comprising a tab flap of sufficient length and width attached at the center to the back of said main structure and positioned to fit over a center post of a metal folding stand.

4. The universal music stand slip cover combination pocket folder of claim 1, wherein the front panel is notched at two corners and the middle panel is connected at the sides and at the bottom creating a pocket folder for articles to be placed therein.

5. The universal music stand slip cover combination pocket folder of claim 4, further comprising retaining devices attached at the side edge and to the bottom fold of said pocket at an angle to secure articles for viewing while on said music stand.

6. The universal music stand slip cover combination pocket folder of claim 5, wherein said retaining devices include cords, elastic straps, fabric strips, metal strips, plastic strips, plastic quarter circles, ribbons, or vinyl strips.

7. The universal music stand slip cover combination pocket folder of claim 1, further comprising a means for securing articles within said main structure when said structure is folded in half with its edges fastened together and a means for carrying said structure.

8. The universal music stand slip cover combination pocket folder claim 7, wherein the edges are fastened together with zipper, buttons, buckles, clasp, magnets, ribbons, snaps, or Velcro.

9. The universal music stand slip cover combination pocket folder of claim 7, further comprising a strap.

10. The universal music stand slip cover combination pocket folder of claim 9, further comprising a loop at each end of the center fold line to accommodate the strap.

11. The universal music stand slip cover combination pocket folder of claim 1, wherein said panels are composed of one or more fabrics including durable nylon, canvas, cotton, duck cloth or knit.

12. The universal music stand slip cover combination pocket folder of claim 1, wherein the stabilizer comprises one or more of the following materials including cardboard, composite material, nylon mesh, plastic, iron-on fabric stabilizer, vinyl, or wood.

13. A universal music stand slip cover combination pocket folder comprising a main compartment dimensioned to fit over at least all or a portion of the sheetbearing part of a music stand, with an aperture on at least one side to permit addition to or removal from a music stand, wherein the improvement comprises:

a. a main structure having a rectangular shape with a front, a middle, and an elongated back panel, each connected at the sides to the other panels wherein each panel has two layers of material, wherein the middle panel and the elongated back panel are connected at the sides and at the top, thereby forming an opening at the bottom dimensioned to slip over a flat desk music stand;

b. a stabilizer sandwiched between the two layers of material that rigidly reinforces the joined panels from bending or collapsing, except providing for a bend along the center of the width direction where the combination can fold in half for converting the slipcover into a pocket folder, whereby music, papers, books or accessories are securable on the slip cover to be viewed or stored when the main structure is placed over the music stand, and whereby the music, papers, books or accessories can be stored or transported easily by a human by removing the main structure from the music stand, folding it and forming a pocket folder of the folded portions and placing the items in the pocket folder; and c. a tab flap of sufficient length and width attached at the center to the back of the main structure and positioned to fit over a center post of a metal folding stand.

14. A universal music stand slip cover combination pocket folder comprising a main compartment dimensioned to fit over at least all or a portion of the sheetbearing part of a music stand, with an aperture on at least one side to permit addition to or removal from a music stand, wherein the improvement comprises:

a. a main structure having a rectangular shape with a front, a middle, and an elongated back panel, each connected at the sides to the other panels wherein each panel has two layers of material, wherein the middle panel and the elongated back panel are connected at the sides and at the top, thereby forming an opening at the bottom dimensioned to slip over a flat desk music stand;

b. a stabilizer sandwiched between the two layers of material that rigidly reinforces the joined panels from bending or collapsing, except providing for a bend along the center of the width direction where the combination can fold in half for converting the slipcover into a pocket folder, whereby music, papers, books or accessories are securable on the slip cover to be viewed or stored when the main structure is placed over the music stand, and whereby the music, papers, books or accessories can be stored or transported easily by a human by removing the main structure from the music stand, folding it and forming a pocket folder of the folded portions and placing the items in the pocket folder; and c. a means for securing articles within said main structure when said structure is folded in half with its edges fastened together and a means for carrying said structure.

* * * * *